United States Patent [19]

Goodman et al.

[11] 4,282,087

[45] Aug. 4, 1981

[54] SELECTIVE FLOCCULATION FOR IRON VALUES

[75] Inventors: Richard M. Goodman, Norwalk; Hans P. Panzer, Stamford, both of Conn.

[73] Assignee: American Cyanamid Company, Stamford, Conn.

[21] Appl. No.: 41,031

[22] Filed: May 21, 1979

[51] Int. Cl.[3] ..... B03D 3/06

[52] U.S. Cl. ..... 209/5; 210/734

[58] Field of Search ..... 209/5; 210/54 A, 54 C, 210/702, 704, 714–736

[56] References Cited

U.S. PATENT DOCUMENTS

| | | | |
|---|---|---|---|
| 3,418,237 | 12/1968 | Booth | 209/56 X |
| 3,479,282 | 11/1969 | Chamot | 210/54 A |
| 3,975,496 | 8/1976 | Smalley | 210/54 A X |
| 4,081,357 | 3/1978 | Werneke | 209/5 |
| 4,090,955 | 5/1978 | Dexter | 209/5 |
| 4,137,164 | 1/1979 | Coscia | 210/54 C |

FOREIGN PATENT DOCUMENTS

| | | | |
|---|---|---|---|
| 40-13483 | 6/1965 | Japan | 210/54 |

*Primary Examiner*—Robert Halper

*Attorney, Agent, or Firm*—Paul W. Leuzzi, II

[57] ABSTRACT

An iron ore is finely ground and slurried prior to being subjected to treatment with a selective flocculant for iron values. Subsequent to treatment, the iron values are allowed to settle into the underflow concentrate and be recovered. The selective flocculant employed is a hydroxymethylated polyacrylamide having a high molecular weight and a degree of hydroxymethylation in excess of about 50%.

2 Claims, No Drawings

SELECTIVE FLOCCULATION FOR IRON VALUES

BACKGROUND

Metallic iron is currently derived from magnetite, taconite and hematite ores. In the face of ever dwindling reserves of high grade magnetitic and taconitic ores, it is expected that greatly increased tonnages of hematitic ore will be recovered in the foreseeable future.

Presently, hematite is recovered from the siliceous, non-ferrous mineral matter in which it naturally occurs, through a process of selective flocculation wherein causticized starch is employed as the flocculant. The operation of this process is conducted under alkaline conditions, generally within the range of pH 9–11.5. Although corn starch is the most frequently employed flocculant, U.S. Pat. No. 3,292,780 issued Dec. 20, 1966, to Frommer et al. discloses a process employing tapioca flour as the selective flocculant. Employment of starches in the recovery process has, however, major drawbacks. From an ecological vantage point, the presence of residual starches in the waste water increases the biodegradeable oxygen demand and thereby creates a pollution problem in the disposal of the waste waters. From a commercial vantage point, there are an ever-increasing number of countries in which use of reagents having a food value, such as starch, is prohibited in commercial applications.

Accordingly, there exists the need for a process for recovering hematite from its gangue which at once both overcomes the deficiencies of the conventional process and reduces consumption of products having food value.

SUMMARY OF THE INVENTION

The present invention provides for a process of selective flocculation of hematitic ores from the siliceous material in which it naturally occurs. Hydroxymethylated polyacrylamides having a high degree of hydroxymethylation and a molecular weight in excess of one million have been found to result in surprisingly selective flocculation of hematitic ore. Employment of the hydroxymethylated polyacrylamides of the instant invention frees previously employed starches for utilization as food resources rather than depleting these resources in industrial applications. Additionally, insofaras lower quantities of hydroxymethylated polyacrylamides have been found to achieve effective flocculation, waste waters will now contain lower levels of residuals than had previously been obtainable.

DETAILED DESCRIPTION OF THE INVENTION

In accordance with the present invention, there is provided a process for recovering iron values from a mixture of a hematite ore and its gangue material which comprises slurrying a finely ground hematitic ore in water, treating said slurry with an effective amount of a hydroxymethylated polyacrylamide wherein the hydroxymethylated polyacrylamide has a molecular weight greater than one million and a degree of hydroxymethylation in excess of about 50%, settling the iron values as an underflow concentrate and thereafter recovering the iron concentrate.

The process of the present invention is specifically directed to the separation of hematitic iron ore from siliceous materials. Large deposits of such hematitic ore can be found in the Lake Superior region of the United States.

In carrying out the process of the instant invention the hematitic ore is slurried as a fine grind in water to provide a concentration of about 5 to 20 weight percent based on the total weight of the slurry. The particle size is generally below 350 mesh and preferably below 500 mesh (average particle size approximately 10–15 μm).

After the slurry has been prepared as specified, it is next treated with an effective amount of a hydroxymethylated polyacrylamide of specific composition and molecular weight, as further defined hereinafter. The hydroxymethylated polyacrylamide useful in the process of the present invention must have a molecular weight in excess of approximately one million and have a degree of hydroxymethylation in excess of about 50%.

Useful hydroxymethylated polyacrylamides may be prepared according to any conventional procéss so long as the resultant polymer has the necessary characteristics hereinabove set forth. Such processes include, but are not limited to, the processes whereby synthesis consists of combining a commercially available polyacrylamide having the necessary high molecular weight with an excess of formaldehyde in solution under alkaline conditions and thereafter mechanically stirring the solution for one to three hours at a temperature within the range of 25°–40° C. The solution's pH is then adjusted to 6.0–7.5. The resultant hydroxymethylated polyacrylamide exhibits a degree of hydroxymethylation on the order of 90–100%.

An alternative procedure found to be useful for preparing hydroxymethylated polyacrylamides consists of combining a commercially available, high molecular weight polyacrylamide with a quantity of formaldehyde corresponding to about 50–80 mole percent based on the polyacrylamide in a solution under alkaline conditions. The pH is adjusted to approximately pH 10–11.5. The mixture is continuously stirred for 24 hours at a temperature of 20°–30° C. The resultant hydroxymethylated polyacrylamide exhibits a degree of hydroxymethylation on the order of 50–70%. This resultant polymer is then aged according to either of two methods. Under what will be termed the slow aging process, a diluted sample of the resultant polymer has its pH adjusted to approximately pH 11 and is then allowed to stand for a 24 hour aging period at a temperature of about 20°–30° C. This results in a slow-aged hydroxymethylated polyacrylamide having a significantly higher molecular weight than the hydroxymethylated polyacrylamide produced before aging. Under what will be termed the rapid aging process, the 24 hour aging period of the slow aging process is replaced by a short, 1–2 hour aging period wherein the pH adjusted, diluted solution of the earlier resultant polymer is kept at a temperature within approximately 40°–50° C. The rapid aging process likewise increases the molecular weight of the hydroxymethylated polyacrylamide. Other appropriate procedures of synthesis may be employed without departing from the scope of the present invention.

By "treating" the slurry with the hydroxymethylated polyacrylamide is meant that the specified amount of polymer is added to the slurry which is then vigorously mixed to ensure uniform distribution of the polymer throughout the slurry. By "an effective amount" of the hydroxymethylated polyacrylamide is meant an amount that is effective in recovering hematite from its accompanying gangue material. The particular amount that is effective will vary depending upon the particular ore processed and the specific composition of the polymer employed. Therefore, a precise statement as to the effective amount is not possible. Generally, however, the effective amount will range from about 0.001 to 1.0 pounds per ton of dry solids in the processed slurry. In preferred instances, the effective amount will range from about 0.01 to 0.5 pound per ton of dry solids.

After the slurry has been treated as specified, the iron values are settled as an underflow concentrate while the gangue material remains suspended in the supernatant liquid. Generally, effective settling is accomplished within 15 minutes after treatment has been effected, but the particular time of settling is not deemed critical and will vary widely depending upon the ore processed, the composition of the polymer employed, the dosage of polymer employed and the like.

Once settling has been effectively obtained, the iron concentrate is recovered. This operation can be performed according to any conventional procedure while employing any conventional equipment associated with such procedures. Decantation of the supernatant liquid enables greater facilitation of the recovery process and permits disposal of the gangue materials.

The following specific examples illustrate certain aspects of the present invention, and more particularly, point out methods of evaluating the unique advantages of the process of the instant invention. A general procedure is additionally set forth describing in detail the procedures generally followed. However, the examples and procedures are set forth for illustration only and are not to be construed as limitations on the present invention except as set forth in the appended claims. All parts and percentages are by weight unless otherwise specified.

GENERAL PROCEDURE I

600 Parts of a crude iron ore containing approximately 50% hematite is added to 400 parts of de-ionized water. To this solution is added sodium silicate and sodium hydroxide in amounts sufficient to raise the pH to about 10.5–11.0. The resulting caustic solution is ground to a fine consistency, approximately 85%-500 mesh. This finely ground ore is then diluted to about 7.5% solids. The resultant pulp is stirred into a large vat to maintain slurry consistency and to evaluate settling conditions.

Selective flocculants to be evaluated are next added as dilute solutions and vigorously mixed into the pulp for 15 seconds. The treated pulp is allowed to settle for 6 minutes. After settling, the overflow is carefully siphoned off.

The underflow and overflow are carefully weighed and assayed to determine recovery and grade of the ore. Recovery ($R_u$) of the underflow is defined as:

$$R_u = \frac{(\%\ I.O.U.) \times (\text{wt. } U.)}{[(\%\ I.O.U.) \times (\text{wt. } U.)] + [(\%\ I.O.O.) \times (\text{wt. } O.)]}$$

Recovery ($R_o$) of the overflow is defined as:

$$R_o = 1 - R_u$$

Residual gangue ($G_u$) in the underflow is defined as:

$$G_u = \frac{(100 - \%\ I.O.U.) \times (\text{wt. } U.)}{[(100 - \%\ I.O.U.) \times (\text{wt. } U.)] + [(100 - \%\ I.O.O.) \times (\text{wt. } O.)]}$$

Residual gangue ($G_o$) in the overflow is defined as:

$$G_o = 1 - G_u$$

Grade iron oxide in the underflow ($X_u$) is defined as:

$$X_u = \frac{\text{wt. } I.O.U.}{\text{wt. } U.}$$

Grade iron oxide in the overflow ($X_o$) is defined as:

$$X_o = \frac{\text{wt. } I.O.O.}{\text{wt. } O.}$$

Grade gangue in the underflow ($Y_u$) is defined as:

$$Y_u = \frac{\text{wt. } U. - \text{wt. } I.O.U.}{\text{wt. } U.}$$

Grade gangue in the overflow ($Y_o$) is defined as:

$$Y_o = \frac{\text{wt. } O. - \text{wt. } I.O.O.}{\text{wt. } O.}$$

where $X_u + Y_u = 1$ and $X_o + Y_o = 1$ Selectivity is defined as:

$$\text{Selectivity} = [(R_u \times X_u) - (R_o \times X_o)] - [(G_u \times Y_u) - (G_o \times Y_o)]$$

wherein:

% I.O.U.—percent iron oxide in underflow
% I.O.O.—percent iron oxide in overflow
wt. U.—weight of underflow
wt. O.—weight of overflow where a value of "2" corresponds to perfect selectivity (i.e., 100% of the hematite and none of the gangue in the underflow and, correspondingly, 100% of the gangue and none of the hematite in the overflow). A selectivity of "0 " corresponds to a completely random or non-selective process.

EXAMPLE A

Part A

2551 Parts of distilled water are added to 242 parts of a 50% solution of a commercially available acrylamide. To this mixture is added 0.484 part of a disodium salt of ethylene dinitrilo tetraacetate (EDTA) as a 2% solution, 2.42 parts of isopropyl alcohol and about 2 parts of a 0.5N solution of sodium hydroxide to bring the solution to a pH of about 6.0. The solution is heated to about 30° C. and placed into a suitable reaction vessel where it is vigorously sparged with nitrogen gas for one hour. After sparging, 0.00453 part of sodium metabisulfide as a 0.05% solution and 1.815 parts of ammonium persulfate as a 30% solution are added to the sparged solution to initiate polymerization. After three (3) hours of exothermic reaction an aliquot of the 4.25% polyacrylamide solution is removed.

Part B

750 Parts of the polyacrylamide solution removed from Example A, Part A, is mixed with sufficient parts of a 0.5N sodium hydroxide solution to bring the solution to a pH of 7.0–7.5. To this solution is added 27 parts of a 37% solution of formaldehyde and 2.5 ml. of 10% sodium hydroxide solution, the resultant mixture having a pH on the order of 10.5 to 11.0. This mixture is stirred on rollers at a temperature of 20°–25° C. for 24 hours. The resulting hydroxymethylated polyacrylamide has a degree of hydroxymethylation on the order of 55–60% and a molecular weight of approximately 3 million. The product termed fresh hydroxymethylated polyacrylamide is diluted until a 0.4% solution is obtained.

Part C

The diluted solution of fresh hydroxymethylated polyacrylamide of Example A, Part B, is adjusted with a sodium hydroxide solution until a pH of about 11.0 is obtained. This solution is then allowed to age for 24 hours at a temperature between 20°–25° C. The product is designated slow-aged hydroxymethylated polyacrylamide.

EXAMPLE B

The diluted hydroxymethylated polyacrylamide product of Example A, Part B, is adjusted with a sodium hydroxide solution until a pH of about 11.0 is achieved. This solution is heated for 1–2 hours at a temperature of 40°–50° C. and thereafter cooled to room temperature. The product is designated rapid-aged hydroxymethylated polyacrylamide.

EXAMPLE C

A commercially available polyacrylamide having a molecular weight on the order of six million is diluted until a 1% solution is obtained. 750 Parts of this solution is then added to a sufficient quantity of 0.5N sodium hydroxide solution so as to achieve a pH of 7.0–7.5. To this solution is added 40 parts of a 37% solution of formaldehyde. The resultant mixture is adjusted in pH to 9.5–10.5 and mechanically agitated for 2 hours at 30°–35° C. while maintaining the pH between 9.5–10.5. The hydroxymethylated polyacrylamide obtained has a degree of hydroxymethylation on the order of 90–100%.

COMPARATIVE EXAMPLE 1

The General Procedure I set forth above is followed in every material detail except that no selective flocculant has been added. Test results are set forth in Table I.

COMPARATIVE EXAMPLES 2 & 3

The General Procedure I set forth above is followed in every material detail. The selective flocculant therein employed is a starch prepared according to U.S. Pat. No. 3,292,780, issued to Frommer et al. Test results are set forth in Table I.

COMPARATIVE EXAMPLES 4 & 5

The General Procedure I set forth above is followed in every material detail. The selective flocculant employed is a polyacrylic acid prepared according to U.S. Pat. No. 4,081,357, issued to Werneke et al. Test results are set forth in Tble I.

EXAMPLES 1–3

The General Procedure I set forth above is followed in every material detail. The selective flocculant therein employed is a hydroxymethylated polyacrylamide taken from Part C of Example A. Test results are set forth in Table I.

TABLE I

| Example No. | Dosage lbs./ton | Overflow wt. % | Overflow % Fe | Underflow wt. % | Underflow % Fe | Recovery % Fe | Selectivity Factor |
|---|---|---|---|---|---|---|---|
| Comparative 1 | — | 21.13 | 26.8 | 78.87 | 36.8 | 83.7 | 0.186 |
| Comparative 2 | 0.50 | 16.83 | 25.6 | 83.17 | 36.6 | 87.6 | 0.171 |
| Comparative 3 | 0.80 | 20.20 | 23.6 | 79.80 | 37.1 | 86.1 | 0.213 |
| Comparative 4 | 0.034 | 14.58 | 28.8 | 85.42 | 35.9 | 87.9 | 0.098 |
| Comparative 5 | 0.034 | 18.84 | 27.6 | 82.73 | 36.6 | 86.4 | 0.148 |
| 1 | 0.033 | 19.98 | 26.0 | 80.02 | 36.5 | 85.1 | 0.184 |
| 2 | 0.067 | 14.97 | 23.2 | 85.03 | 36.5 | 89.9 | 0.183 |
| 3 | 0.133 | 17.34 | 23.2 | 82.66 | 37.9 | 88.6 | 0.246 |

GENERAL PROCEDURE II

The General Procedure I set forth above is followed in every material detail except that deionized water is used throughout the process. Additionally, to the resultant pulp is mixed 0.1 part of calcium hydroxide (equivalent to 17 ppm of calcium as calcium carbonate in the final solution) which is stirred vigorously to simulate a softened water containing residual calcium hardness. 1000 Parts of this mixed pulp is taken and placed into a container fitted with porous stainless steel plungers.

After the mixed pulp has been treated and settled according to General Procedure I, the top 900 parts are siphoned off as the overflow. The overflow and underflow are weighed, assayed and results computed as set forth in General Procedure I.

COMPARATIVE EXAMPLE 6

General Procedure II is followed in every material detail except that no selective flocculant is employed. Test results are set forth in Table II.

COMPARATIVE EXAMPLES 7–9

General Procedure II is followed in every material detail. The selective flocculant employed is a starch prepared according to U.S. Pat. No. 3,292,780 issued to Frommer et al. Test results are set forth in Table II.

COMPARATIVE EXAMPLES 10 & 11

General Procedure II set forth above is followed in every material detail. The selective flocculant employed is a polyacrylic acid prepared according to U.S. Pat. No. 4,081,357, issued to Werneke et al. Test results are set forth in Table II.

EXAMPLES 4 & 5

General Procedure II is followed in every material detail. The selective flocculant employed is a hydroxymethylated polyacrylamide taken from Part B, Example A. Test results are set forth in Table II.

Although these examples exhibit a slight decrease in recovery, the selectively has dramatically increased.

EXAMPLES 6 & 7

General Procedure II is followed in every material detail. The selective flocculant employed is a hydroxymethylated polyacrylamide taken from Part C, Example A. Test results are set forth in Table II.

EXAMPLES 8 & 9

General Procedure II is followed in every material detail. The selective flocculant employed is a hydroxymethylated polyacrylamide taken from Example 2. Test results are set forth in Table II.

EXAMPLES 10 & 11

General Procedure II is followed in every material detail. The selective flocculant employed is a hydroxymethylated polyacrylamide taken from Example C. Test results are set forth in Table II.

TABLE II

| Example No. | Dosage lb./ton | Overflow wt. % | Overflow % Fe | Underflow wt. % | Underflow % Fe | Recovery % Fe | Selectivity Factor |
|---|---|---|---|---|---|---|---|
| Comparative 6 | — | 53.9 | 26.0 | 46.1 | 41.1 | 57.6 | .435 |
| Comparative 7 | 0.447 | 20.6 | 18.4 | 79.4 | 39.2 | 89.1 | .398 |
| Comparative 8 | 0.450 | 23.3 | 17.2 | 76.7 | 40.5 | 88.8 | .473 |
| Comparative 9 | 0.809 | 25.7 | 17.2 | 74.3 | 40.6 | 87.2 | .504 |
| Comparative 10 | 0.034 | 20.4 | 25.0 | 79.6 | 39.4 | 86.0 | .292 |
| Comparative 11 | 0.037 | 24.7 | 22.0 | 75.3 | 38.8 | 84.3 | .352 |
| 4 | 0.106 | 33.2 | 22.4 | 66.8 | 40.1 | 78.3 | .443 |
| 5 | 0.132 | 33.3 | 22.8 | 66.7 | 39.6 | 77.7 | .404 |
| 6 | 0.152 | 17.8 | 18.4 | 82.2 | 37.8 | 90.4 | .312 |
| 7 | 0.128 | 21.4 | 16.8 | 78.6 | 38.0 | 89.2 | .379 |
| 8 | 0.082 | 20.8 | 15.6 | 79.2 | 39.1 | 90.5 | .429 |
| 9 | 0.053 | 25.3 | 16.4 | 74.7 | 40.5 | 87.9 | .511 |
| 10 | 0.065 | 31.6 | 15.6 | 68.4 | 42.3 | 85.4 | .644 |
| 11 | 0.128 | 21.3 | 10.8 | 78.7 | 40.7 | 93.3 | .560 |

What is claimed is:

1. A process for recovering iron values from a mixture of hematitic ore and its gangue material which comprises:

(a) slurrying a finely ground hematitic ore in water;

(b) treating said slurry with an effective amount of a hydroxymethylated polyacrylamide wherein the hydroxymethylated polyacrylamide has a molecular weight in excess of six million and has a degree of hydroxymethylation in excess of about 90%.

(c) settling the iron values as an underflow concentrate; and (d) recovering the iron concentrate.

2. The process of claim 1 wherein the slurry water contains residual amounts of calcium.

* * * * *